US009480328B2

(12) United States Patent
Stevens

(10) Patent No.: US 9,480,328 B2
(45) Date of Patent: Nov. 1, 2016

(54) STABILIZING BELT CLIP

(71) Applicant: Nathaniel D. Stevens, Chula Vista, CA (US)

(72) Inventor: Nathaniel D. Stevens, Chula Vista, CA (US)

( * ) Notice: Subject to any disclaimer, the term of this patent is extended or adjusted under 35 U.S.C. 154(b) by 212 days.

(21) Appl. No.: 14/455,721

(22) Filed: Aug. 8, 2014

(65) Prior Publication Data

US 2016/0037899 A1 Feb. 11, 2016

(51) Int. Cl.
*A45C 1/04* (2006.01)
*A45F 5/02* (2006.01)

(52) U.S. Cl.
CPC ..... *A45F 5/021* (2013.01)

(58) Field of Classification Search
CPC ... A45F 5/021; A45F 3/047; A45F 2003/144
USPC ..... 224/667
See application file for complete search history.

(56) References Cited

U.S. PATENT DOCUMENTS 4,387,489 A * 6/1983 Dudek ..... A44B 11/06 24/133
4,604,772 A * 8/1986 Arff ..... A44B 11/125 24/170
5,201,099 A * 4/1993 Campbell ..... A44B 11/04 24/186
5,235,728 A * 8/1993 Nordberg ..... A45F 5/02 224/667
6,145,169 A * 11/2000 Terzuola ..... A44B 11/005 24/163 K
6,510,592 B1 * 1/2003 Hamilton ..... A44B 11/06 24/170
8,776,332 B2 * 7/2014 Kosh ..... A44B 11/2511 24/163 K
9,173,454 B2 * 11/2015 Liu ..... A44B 11/006
2007/0226958 A1 * 10/2007 Clifton ..... A45F 5/02 24/3.12
2010/0294822 A1 * 11/2010 Haight ..... A45F 5/02 224/666

* cited by examiner

*Primary Examiner* — Derek Battisti
(74) *Attorney, Agent, or Firm* — GSS Law Group

(57) ABSTRACT

A belt clip for securing an article to the belt of a user is provided. A belt clip including a movable member and a stationary member, a first end of the movable member hinge coupled to a first end of the stationary member. A second end of the stationary member comprising a first locking tab aperture dimensioned to receive a first locking tab of the movable member and a second locking tab aperture dimensioned to receive a second locking tab of the movable member. The movable member and the stationary member spaced apart from each other to accommodate a portion of the belt of a user and the stationary member comprising at least one article receiving void for securing an article to the belt clip.

13 Claims, 4 Drawing Sheets

STABILIZING BELT CLIP

TECHNICAL FIELD

The present application relates generally to a belt clip for supporting an article on a belt worn by a user, and more particularly to a belt clip for supporting an article on a belt worn by a user that is effective in stabilizing the article in a desired orientation relative to the user wearing the belt.

BACKGROUND

Various belt clips are known in the art for securing an article to a belt worn by a user. Additionally, a wide variety of belts also exist in the art, including conventional belts, which are commonly secured to a user's article of clothing by a series of belt loops, and utility belts, which may be secured to a user by a variety of other means known in the art. In a typical configuration, a desired article is removably secured to one portion of a belt clip and another portion of the belt clip is then removably secured to a user's belt by an attachment device, such as a spring loaded mechanism. In some instances, the belt clip may be locked onto the user's belt.

Users of belt clips may include both civilian and military or law enforcement personnel. In the case of military or law enforcement personnel, typical articles that may be used in combination with a belt clip, may include, a firearm holster, a knife sheath, handcuffs, a chemical deterrent substance, a flashlight, etc. For users carrying these articles, it is desirable that the article be secured by the belt clip and positioned on the user's belt such that the article is readily accessible and is delivered to the hand of the user in a desired orientation. A user instinctively reaching for an article secured to a belt clip expects the article to be located at a specification location on the belt and at a particular orientation. For example, law enforcement personnel instinctively reaching for a firearm in a firearm holster expect the holster to be positioned within easy reach and orientated such that the handle of the firearm can be properly grasped. As such, it is undesirable for a belt clip to shift along the length of the belt or to rotate on the belt, thereby changing the orientation of the article relative to the user. However, while belt clips are known in the art for securing an article to a belt, the belt clips currently known in the art are not designed to prevent the belt clip from shifting and rotating the secured article relative to the user.

Accordingly, there is a need in the art for a belt clip that provides stability for the article relative to the belt, that maintains a desired orientation and position of the article on a user's belt and that is designed to prevent the belt clip from shifting and rotating on the belt.

SUMMARY

In accordance with the present invention, a belt clip for securing an article to the belt of a user that provides stability for the article relative to the belt is described. The belt clip maintains a desired orientation and position of an article on a user's belt and is designed to prevent the belt clip from shifting and rotating on the belt.

In accordance with an embodiment of the present invention, a belt clip for supporting an article on a belt of a user includes a substantially rectangular movable member having a first locking tab and a second locking tab extending from a first end of the movable member and a first receiving aperture and a second receiving aperture positioned at a second end of the movable member. The belt clip further includes a stationary member having a substantially rectangular central expanse, a first end cap positioned substantially perpendicular to the central expanse at a first end of the stationary member and a second end cap positioned substantially perpendicular to the central expanse at a second end of the stationary member, the first end cap includes a first locking tab aperture dimensioned to receive the first locking tab of the movable member and a second locking tab aperture dimensioned to receive the second locking tab of the movable member and the second end cap includes a first hinge receiving section and a second hinge receiving section. The belt clip additionally includes a first hinged tab secured to the second end cap of the stationary member at the first hinge receiving section and a second hinged tab secured to the second end cap of the stationary member at the second hinge receiving section, the first hinged tab and the second hinged tab for hinge coupling the movable member to the stationary member by inserting the first hinged tab into the first receiving aperture of the moveable member and by inserting the second hinged tab into the second receiving aperture of the moveable member.

In an additional embodiment, the belt clip is configured to be locked onto the user's belt and the belt clip further includes, a first locking wing coupled to a first edge of the central expanse of the stationary member, proximate to the second end cap and a second locking wing coupled to a second edge of the central expanse of the stationary member, proximate to the second end cap. The first locking wing may further include a first locking wing flange, the first locking wing flange dimensioned to engage with the first hinged tab when the first locking tab of the movable member is inserted into the first locking tab aperture of the stationary member and the second locking wing may further include a second locking wing flange, the second locking wing flange dimensioned to engage with the second hinged tab when the second locking tab of the movable member is inserted into the second locking tab aperture of the stationary member.

DETAILED DESCRIPTION

Figure 1:
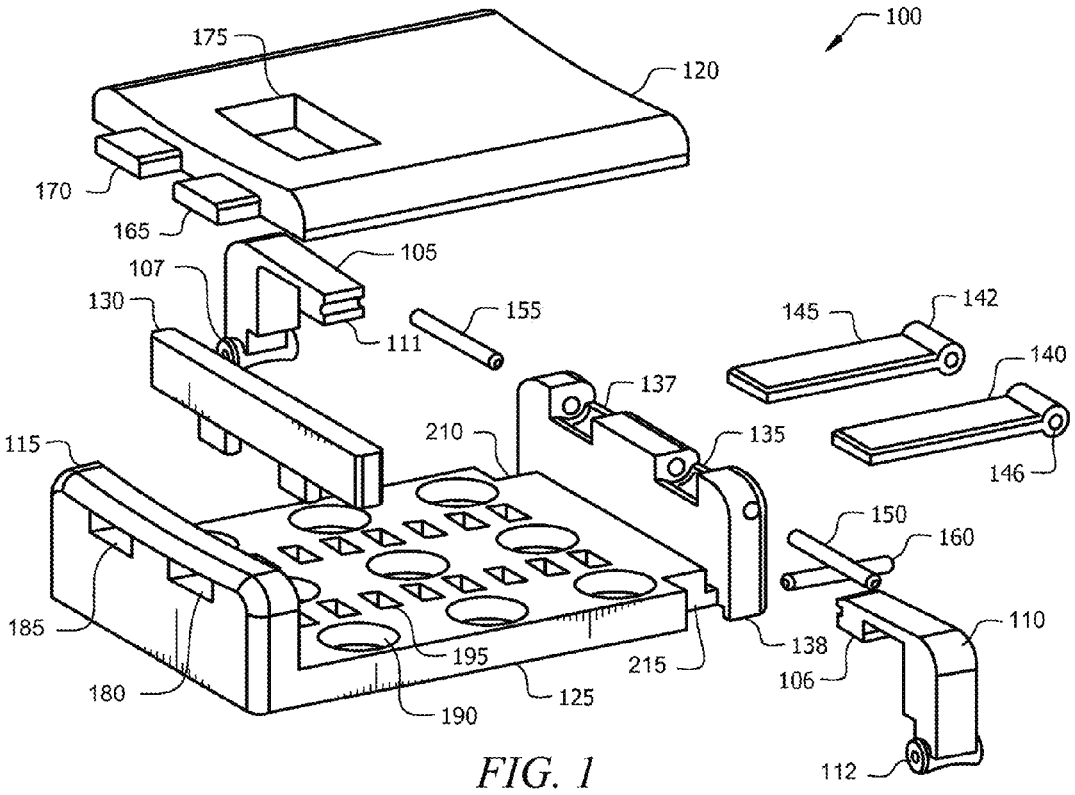
FIG. 1 a diagrammatic view of the components of the belt clip in accordance with an embodiment of the present invention.

Those of ordinary skill in the art will realize that the following detailed description of embodiments in this specification is illustrative only, and is not intended to be in any way limiting. Other embodiments will readily suggest themselves to such skilled persons having the benefit of this disclosure. It will be apparent to one skilled in the art that these specific details may not be required to practice the embodiments. In the following description of the embodiments, substantially the same parts are denoted by the same reference numerals.

With reference to FIG. 1, a belt clip 100 for supporting an article on a belt of a user is illustrated and, in general, includes a movable member 120 hinge coupled to a stationary member 125 by a pair of hinged tabs 140, 145 a sizing bar 130 positioned along the central expanse of the stationary member 125 and a pair of locking wings 105, 110 hinge coupled to the stationary member 125 using the hinged tabs 140, 145 and movable to engage a pair of locking tabs 165, 170 with a pair of locking tab apertures 180, 185.

A substantially rectangular movable member 120 of the belt clip 100 includes a first locking tab 165 and a second locking tab 170 extending from a first end of the movable member 120 and a first receiving aperture 200 (not shown in this view) and a second receiving aperture 205 (not shown in this view) positioned at a second end of the movable member 120. In one embodiment, the movable member 120 may further include an engagement aperture 175 positioned proximate to the first end of the movable member 120. The engagement aperture 175 is dimensioned to provide a user with an aperture in which to insert a finger or thumb of the user for the purpose of moving the movable member 120 in a direction substantially parallel to the stationary member 125.

A stationary member 125 of the belt clip 100 includes a substantially rectangular central expanse, a first end cap 115 positioned substantially perpendicular to the central expanse at a first end of the stationary member 125 and a second end cap 138 positioned substantially perpendicular to the central expanse at a second end of the stationary member 125. The first end cap 115 includes a first locking tab aperture 180 dimensioned to receive the first locking tab 165 of the movable member 120 and a second locking tab aperture 185 dimensioned to receive the second locking tab 170 of the movable member 120. The second end cap 138 of the stationary member 125 includes a first hinge receiving section 137 and a second hinge receiving section 135.

The belt clip 100 further includes, a first hinged tab 145 secured to the second end cap 138 of the stationary member 125 at the first hinge receiving section 137 and a second hinged tab 140 secured to the second end cap 138 of the stationary member 125 at the second hinge receiving section 135, the first hinged tab 145 and the second hinged tab 140 for hinge coupling the movable member 120 to the stationary member 125 by inserting the first hinged tab 145 into the first receiving aperture 200 (not shown in this view) of the moveable member 120 and by inserting the second hinged tab 140 into the second receiving aperture 205 (not shown in this view) of the moveable member 120. In one embodiment, the first hinged tab 145 includes a substantially cylindrical first hinge pin receiving portion 142 and the second hinged tab 140 includes a substantially cylindrical second hinge pin receiving portion 146. The first hinge pin receiving portion 142 of the first hinged tab 145 is positioned within a cavity of the first hinge receiving section 137 of the stationary member 125 and a first hinge pin 155 is inserted through the first hinge pin receiving portion 142 of the first hinged tab 145 and then through a void in the first hinge receiving section 137 of the stationary member 125 to secure the first hinged tab 145 to the stationary member 125. The second hinge pin receiving portion 146 of the second hinged tab 140 is positioned within a cavity of the second hinge receiving section 135 of the stationary member 125 and a second hinge pin 150 is inserted through the second hinge pin receiving portion 146 of the second hinged tab 140 and then through a void in the second hinge receiving section 135 of the stationary member 125 to secure the second hinged tab 140 to the stationary member 125.

In a particular embodiment, the belt clip 100 further includes a locking mechanism for locking the movable member 120 to the stationary member 125 utilizing a pair of locking wings 105,110. In this embodiment, the belt clip 100 includes a first locking wing 110 coupled to a first edge of the central expanse of the stationary member 125, proximate to the second end cap 138 and a second locking wing 105 coupled to a second edge of the central expanse of the stationary member 125, proximate to the second end cap 138. In a specific embodiment, the first locking wing 110 comprises a substantially cylindrical first locking wing hinge pin receiving portion 112 and the second locking wing 105 comprises a substantially cylindrical second locking wing hinge pin receiving portion 107. The first edge of the central expanse comprises a first locking wing hinge cavity 215 for receiving the first locking wing hinge pin receiving portion 112 of the first locking wing 110 and the second edge of the central expanse comprises a second locking wing hinge cavity 210 for receiving the second locking wing hinge pin receiving portion 107 of the second locking wing 105. The first locking wing 110 is secured to the stationary member 125 at the first locking wing hinge cavity 215 by a first locking wing hinge pin 160 and the second locking wing 105 is secured to the stationary member 125 at the second locking wing hinge cavity 210 by a second locking wing hinge pin (not shown). The first locking wing 110 may further include a first locking wing flange 106 that is dimensioned to engage with the first hinged tab 140 when the movable member 120 is positioned such that the first locking tab 165 of the movable member 120 is inserted into the first locking tab aperture 180 of the stationary member 125 and the second locking wing 105 may further include a second locking wing flange 111 that is dimensioned to engage with the second hinged tab 145 when the movable member 120 is positioned such that the second locking tab 170 of the movable member 120 is inserted into the second locking tab aperture 185 of the stationary member 125. Engaging the first locking wing 110 with the first hinged tab 140 and engaging the second locking wing 105 with the second hinged tab 145 results in the locking of the movable member 120 to the stationary member 125.

To accommodate belts of various dimensions, the belt clip 100 may further include a sizing bar 130 orientated transversely along the central expanse of the stationary member 125 and adjustably positioned between the first end cap 115 of the stationary member and the second end cap 138 of the stationary member. To allow for the adjustability along the central expanse of the stationary member 125, the stationary member 125 may further include at least one sizing bar void 195 for receiving and securing the sizing bar 130 to the stationary member 130. The sizing bar 130 is positioned to accommodate the width of a belt placed between the movable member 120 and the stationary member 125. The sizing bar 130 is positioned along the central expanse to conform to the width of the belt and therefore may be positioned substantially adjacent to the belt to stabilize the belt clip 100 on the belt and to prevent the belt clip 100 from rotating on the belt of the user.

To secure an article to the belt clip 100 worn by a user, the belt clip 100 further includes at least one article receiving void 190. The article receiving voids 190 allow for the attachment of one or more articles to the belt clip 100. The article to be secured to the belt clip 100 may include, but is not limited to, a firearm holster, a knife sheath, handcuffs, a chemical deterrent substance and a flashlight.

Figure 2A:
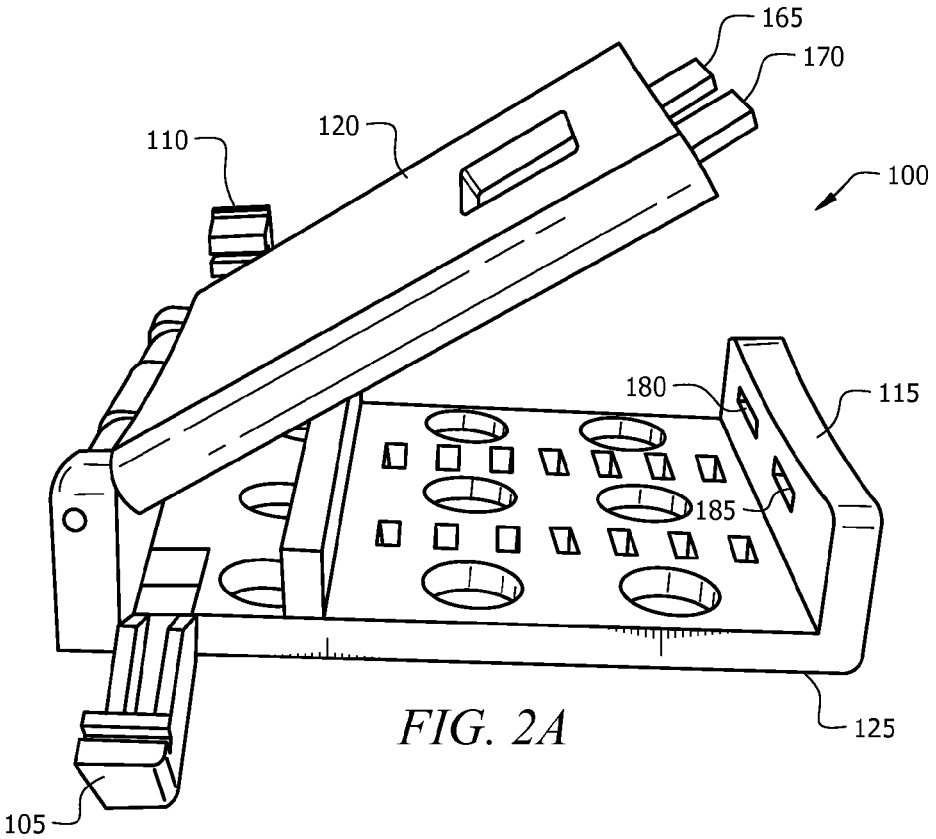
FIG. 2A is a diagrammatic view of the belt clip in an open position in accordance with an embodiment of the present invention.
Figure 2B:
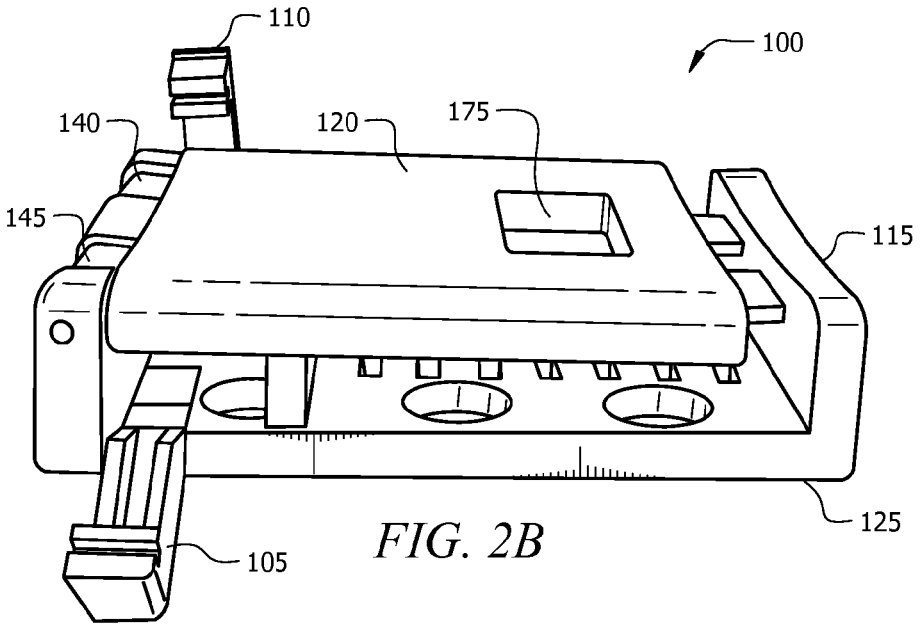
FIG. 2B is a diagrammatic view of the belt clip in a closed, unengaged and unlocked position in accordance with an embodiment of the present invention.
Figure 2C:
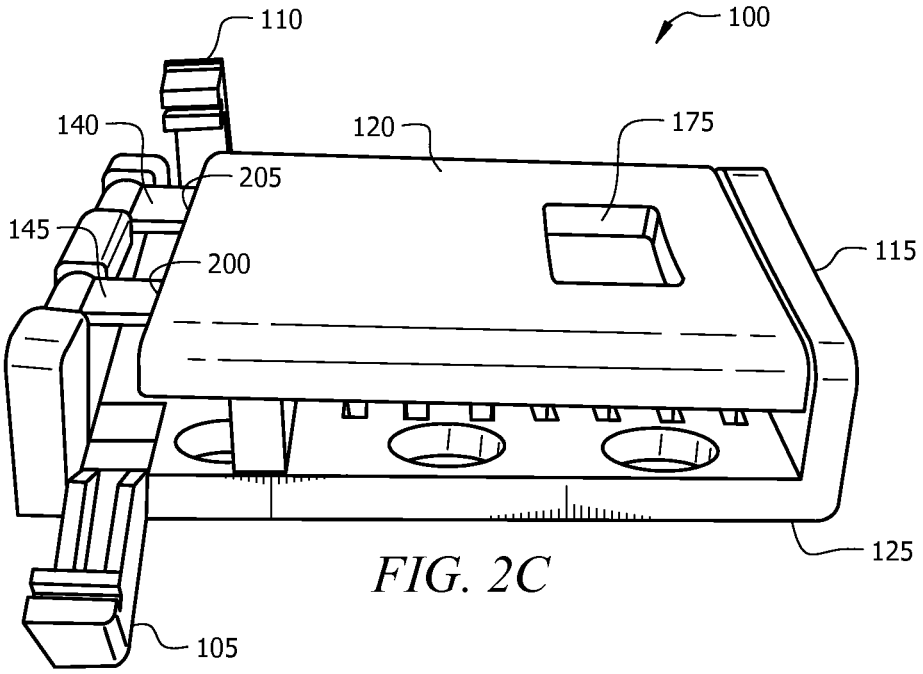
FIG. 2C is diagrammatic view of the belt clip in a closed, engaged and unlocked position in accordance with an embodiment of the present invention.

With reference to FIG. 2A-2C, a belt clip 100 that maintains the orientation of an article attached to the belt clip 100 when the belt clip 100 is secured to a user's belt through the cooperation of a movable member 120, a stationary member 125 and a sizing bar 130 is illustrated.

Referring to FIG. 2A, the belt clip 100 of the present invention is depicted in an open condition, wherein the movable member 120 is hinge coupled to the stationary member by a first hinged tab 145 and a second hinged tab 140 inserted into a first receiving aperture 205 and a second receiving aperture 210 positioned at a second end of the movable member 120. The first receiving aperture 205 and the second receiving aperture 210 are dimensioned to accommodate substantially the full length of the first hinged tab 140 and a second hinged tab 145. In the open condition, the first hinged tab 145 and the second hinged tab 140 are inserted into the first receiving aperture 205 and the second receiving aperture 210 of the movable member 120 such that the second end of the movable member 120 is substantially flush with the second end cap 138 of the stationary member 125 and the locking tabs 165, 170 of the movable member 120 are not inserted into the locking tab apertures 180, 185 of the stationary member 125. Additionally, in the open condition, the first locking wing 110 and the second locking wing 105 are not engaged with the first hinged tab 145 and the second hinged tab 140. In the condition illustrated in FIG. 2A, the belt clip 100 is prepared to receive a belt worn by a user. To secure the belt clip 100 to the belt, the belt is positioned, lengthwise, between the first end 115 of the stationary member 125 and the sizing bar 130, which is positioned transversely along the central expanse of the stationary member 125 to accommodate the width of the belt.

With reference to FIG. 2B, the belt clip 100 is depicted in a closed, but unengaged and unlocked condition. As shown in FIG. 2B, after the belt has been positioned between the movable member 120 and the stationary member 125 of the belt clip 100, the movable member 120 is rotated about the hinge formed by the cooperation of the first hinged tab 145 and the second hinged tab 140 with the movable member 120 until the locking tabs 165,170 of the movable member 120 are aligned with the locking tab apertures 180, 185 of the stationary member 125. In the condition illustrated in FIG. 2B, the movable member 120 is positioned such that the second end of the movable member 120 remains substantially flush with the second end 138 of the stationary member 125 and the locking tabs 165, 170 of the movable member 120 are not inserted into the locking tab apertures 180, 185 of the stationary member 125.

With reference to FIG. 2C, the belt clip 100 is depicted in a closed and engaged, but unlocked condition. As shown in FIG. 2C, after the locking tabs 165, 170 of the movable member 120 are aligned with the locking tab apertures 180, 185 of the stationary member 125, the user can slide the movable member 120 toward the first end cap 115 of the stationary member 125, causing the first locking tab 165 of the movable member 120 to be inserted into the first locking tab aperture 180 of the stationary member 125 and the second locking tab 170 of the movable member 120 to be inserted into the second locking tab aperture 185 of the stationary member 125. As shown in FIG. 2*e*, moving the movable member 120 away from the second end cap 138 of the stationary member 125 and towards the first end cap 115 of the stationary member 125 exposes a portion of the first hinged tab 145 and a portion of the second hinged tab 140. In one embodiment, a user may insert a finger or thumb into the engagement aperture 175 to assist the user in sliding the movable member 120 toward the second end cap 138 of the stationary member 125 causing the locking tabs 165, 170 of the movable member 120 to be inserted into the locking tab apertures 180, 185 of the stationary member 125.

Figure 3A:
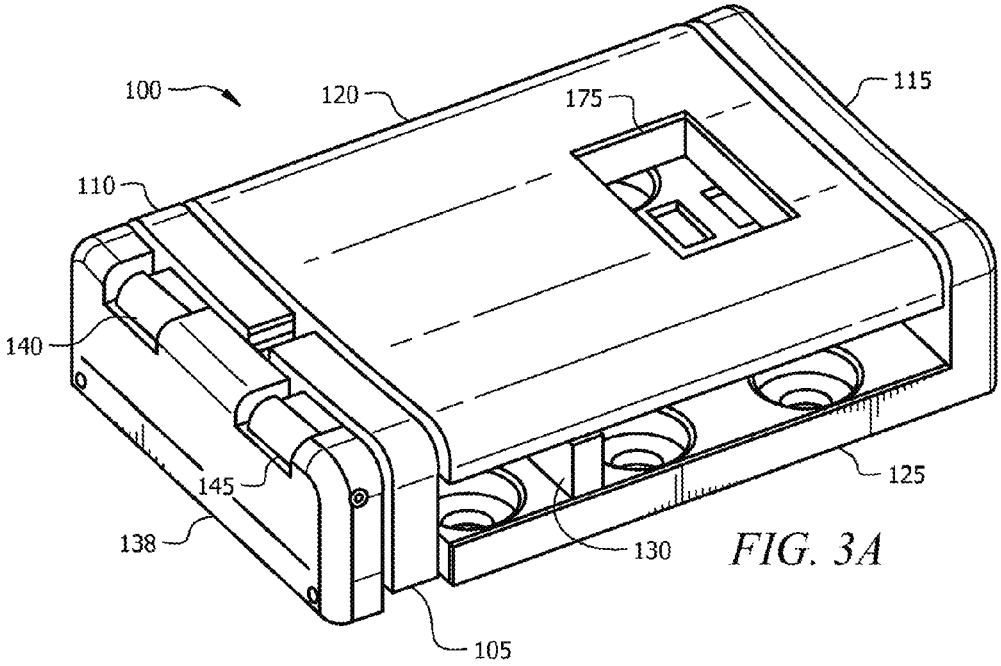
FIG. 3A is a diagrammatic top view of the belt clip in a closed, engaged and locked position in accordance with an embodiment of the present invention.
Figure 3B:
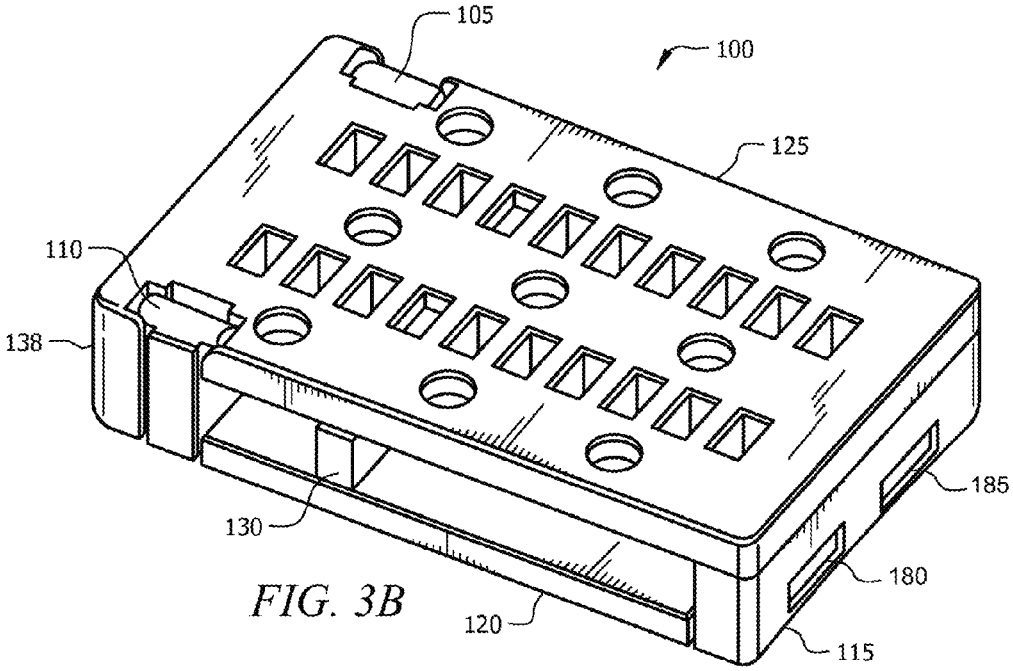
FIG. 3B is a diagrammatic bottom view of the belt clip in a closed, engaged and locked position in accordance with an embodiment of the present invention.

With reference to FIG. 3A, a top view of the belt clip 100 is depicted in a closed, engaged and locked condition. In this condition, after the belt has been positioned between the movable member 120 and the stationary member and the locking tabs 165, 170 of the movable member 120 have been inserted into the locking tab apertures 180, 185 of the stationary member 125, the first locking wing 110 and the second locking wing 105, which are hinge coupled to the stationary member 125, are rotated about the hinge to engage the first locking wing 110 with the second hinged tab 140 and to engage the second locking wing 105 with the first hinged tab 145, thereby locking the belt clip 100 in a desired position and orientation on the user's belt. In this condition, the first locking wing flange 106 of the first locking wing 110 is engaged with the second hinged tab 140 and the second locking wing flange 111 of the second locking wing 105 is engaged with the first hinged tab 145. With reference to FIG. 3A, a bottom view of the belt clip 100 is depicted in a closed, engaged and locked condition.

In accordance with the present invention, a belt clip 100 is described with can be secured to, and removed from, a user's belt and is effective in securing an article to the belt of a user that provides stability for the article relative to the belt is described. The sizing bar 130 of the belt clip 100 allows the belt clip to be adjusted to the width of the user's belt, which allows the belt clip 100 to maintain a desired orientation and position of the article on the user's belt. The locking mechanism of the belt clip 100 is designed to prevent the belt clip 100 from shifting and rotating on the belt as is described and illustrated in the present application.

The foregoing descriptions of specific embodiments of have been presented for purposes of illustration and description. They are not intended to be exhaustive or to limit the invention to the precise forms disclosed, and obviously many modifications and variations are possible in light of the above teaching. The embodiments were chosen and described in order to best explain the principles and practical applications, to thereby enable others skilled in the art to best utilize the various embodiments with various modifications as are suited to the particular use contemplated. It is intended that the scope be defined by the claims appended hereto and their equivalents.

The invention claimed is:

1. A belt clip, comprising:

a substantially rectangular movable member comprising a locking tab extending from a first end of the movable member and a second end of the movable member formed with a receiving aperture;

a stationary member comprising a substantially rectangular central expanse, a first end cap joined substantially perpendicular to the central expanse at a first end of the stationary member and a second end cap joined substantially perpendicular to the central expanse at a second end of the stationary member, the first end cap formed with a locking tab aperture;

a hinged tab secured to the second end cap, an end of the hinged tab engaged with the receiving aperture;

a locking wing secured to the stationary member adjacent the second end cap;

an engaged position of the movable member comprising a displacement of the movable member along the hinged tab, away from the second end cap and toward the first end cap, with the locking tab engaged in the locking tab aperture;

a locked position of the movable member, comprising:

the engaged position;

the locking wing interposed between the second end cap and the second end of the movable member; and the locking wing engaged with the hinged tab; and an open position of the movable member, comprising:

the locking wing disengaged from the hinged tab; and a displacement of the movable member along the hinged tab, away from the first end cap and toward the second end cap, until the locking tab disengages from the receiving aperture.

2. The belt clip of claim 1, wherein the movable member further comprises an engagement aperture positioned proximate to the first end of the movable member.

3. The belt clip of claim 1, wherein the hinged tab comprises a substantially cylindrical hinge pin receiving portion rotatably engaged to the second end cap with a hinge pin.

4. The belt clip of claim 3, wherein the movable member second end cap is formed with a cavity to receive the hinge pin receiving portion.

5. The belt clip of claim 1, further comprising a second of the hinged tab secured to the second end cap, the second hinged tab engaged with a second of the receiving aperture formed in the second end of the movable member.

6. The belt clip of claim 1, further comprising a sizing bar orientated transversely along the central expanse of the stationary member and adjustably positioned between the first end of the stationary member and the second end of the stationary member.

7. The belt clip of claim 1, wherein the central expanse of the stationary member further comprises at least one sizing bar void for receiving a sizing bar to be orientated transversely along the central expanse of the stationary member and adjustably positioned between the first end of the stationary member and the second end of the stationary member.

8. The belt clip of claim 1, wherein the central expanse of the stationary member further comprises at least one article receiving void.

9. The belt clip of claim 1, wherein the locking wing is a first locking wing coupled to a first edge of the central expanse of the stationary member, proximate to the second end cap, and further comprising a second locking wing coupled to a second edge of the central expanse of the stationary member, proximate to the second end cap.

10. The belt clip of claim 9, wherein the first edge of the central expanse comprises a first locking wing hinge cavity for receiving the first locking wing and the second edge of the central expanse comprises a second locking wing hinge cavity for receiving the second locking wing.

11. The belt clip of claim 10, further comprising a first locking wing hinge pin to secure the first locking wing to the stationary member at the first locking wing hinge cavity and a second locking wing hinge pin to secure the second locking wing to the stationary member at the second locking wing hinge cavity.

12. The belt clip of claim 9, wherein the first locking wing further comprises a locking wing flange, the locking wing flange dimensioned to engage with the hinged tab when the locking tab of the movable member is inserted into the locking tab aperture of the stationary member.

13. The belt clip of claim 1, wherein the open position further comprises:

the locking wing rotated away from the movable member, and the hinged tab and the movable member rotated together away from the first end cap.

* * * * *